United States Patent [19]

Lo

[11] Patent Number: 4,943,049

[45] Date of Patent: Jul. 24, 1990

[54] WIND-DRAG TYPE CLIMBER

[76] Inventor: Peter K. C. Lo, P.O. Box 13-124, Taipei, Taiwan

[21] Appl. No.: 430,784

[22] Filed: Nov. 2, 1989

[51] Int. Cl.[5] ..... A63B 23/04

[52] U.S. Cl. ..... 272/70

[58] Field of Search ..... 272/70, 71, 72, 73, 272/69, 129, 96, 97, 134, 128, 130; 128/25 R

[56] References Cited

U.S. PATENT DOCUMENTS

| | | | |
|---|---|---|---|
| 3,747,924 | 7/1973 | Champoux | 272/70 |
| 3,970,302 | 7/1976 | McFee | 272/130 |
| 4,708,338 | 11/1987 | Potts | 272/70 |
| 4,720,093 | 1/1988 | Del Mar | 272/128 |
| 4,830,362 | 5/1989 | Ball | 272/130 |
| 4,838,543 | 6/1989 | Armstrong | 272/96 |

*Primary Examiner*—Stephen R. Crow

[57] ABSTRACT

A climber includes two swing arms which carry pedals at the free ends thereof. A drawing member is fastened to the intermediate portions of the swing arms and is guided so that, when a user steps on and moves one of the pedals downward, the other of the pedals moves upward. The reciprocal movement of the drawing member rotates a wheel axle in a predetermined direction. A hub is sleeved rotatably on the wheel axle and is connected to the same by a speed-increasing mechanism. A wheel body is sleeved rigidly on the hub and has a plurality of generally radially extending wheel blades. The rotational speed of the wheel body is much greater than that of the wheel axle.

5 Claims, 8 Drawing Sheets

WIND-DRAG TYPE CLIMBER

BACKGROUND OF THE INVENTION

This invention relates to an exercise climber, more particularly to a wind-drag type climber.

Referring to FIG. 1, a conventional climber includes a roller 1A which is disposed on an intermediate portion of a strut 2A. A cable 3A extends around the roller 1A. Two hydraulic cylinders 4A are respectively connected to two swing rods 5A each of which carries a pedal 6A. Each of the cylinders 4A includes a connector 7A which is slidable along the slide slot 8A in the swing rod 5A. After the connector 7A is moved to a selected position in the slide slot 8A, it can be locked on the swing rod 5A. Because the reciprocal movement of the pedals 6a is effected via the cylinders 4A, the exercise effect of the illustrated climber is limited.

SUMMARY OF THE INVENTION

It is therefore the main object of this invention to provide a wind-drag type climber which can offer an intense amount of exercise to the user.

According to this invention, a climber includes two swing arms each of which is mounted pivotally on a base frame at an end thereof. Two pedals are respectively carried on the other ends of the swing arms. A wheel axle is journalled on the base frame. Two first annular members are sleeved rotatably on two end portions of the wheel axle. Two unidirectional bearings are respectively interposed between the wheel axle and the first annular members so as to lock the first annular members on the wheel axle when the first annular members rotate in a predetermined direction. Two second annular members are mounted rotatably on the base frame. A drawing member extends around one of the first annular members, the second annular members and the other of the first annular members. Each end of the drawing member is fastened to a selected one of several positions along the length of one of the swing rods by means of a positioning device. When a user steps on and moves one of the pedals downward, the other of the pedals is moved upward. The reciprocal movement of the drawing member alternately rotates the first annular members in clockwise and counterclockwise directions, thereby rotating the wheel axle in the predetermined direction. A hub is sleeved rotatably on the wheel axle. A wheel body is sleeved rigidly on the hub and has a plurality of generally radially extending wheel blades which create an air impedance to the rotation of the wheel body. A speed-increasing mechanism interconnects the wheel axle and the hub so as to rotate the hub at a speed which is greater than that of the wheel axle, thereby creating a significant air impedance to the rotation of the wheel body. The higher the rotational speed of the wheel body, the more air impedance to the rotation of the wheel body, increasing the amount of exercise to the user.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
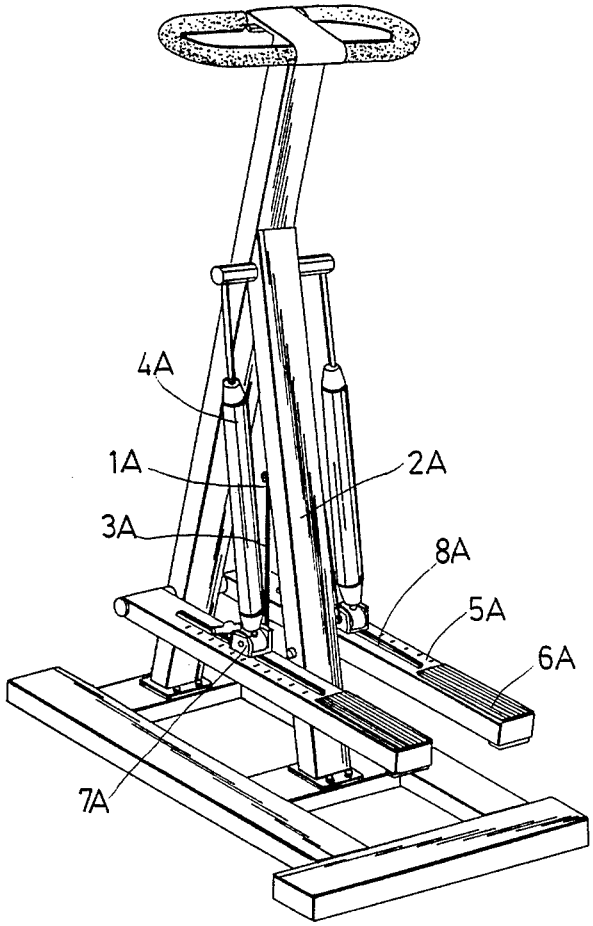
FIG. 1 PRIOR ART
FIG. 1 is a perspective view of a conventional climber.
Figure 2:
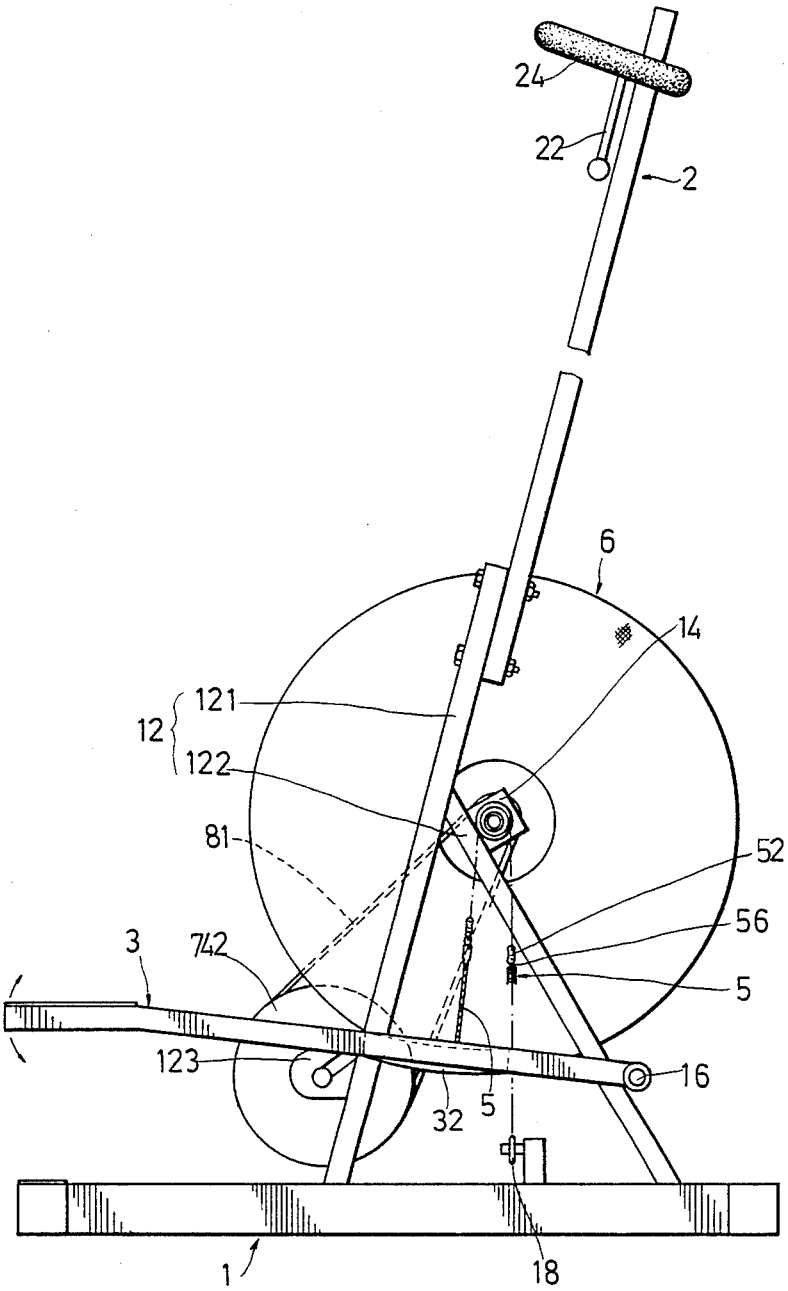
FIG. 2 is a schematic side view of a climber according to this invention.
Figure 3:
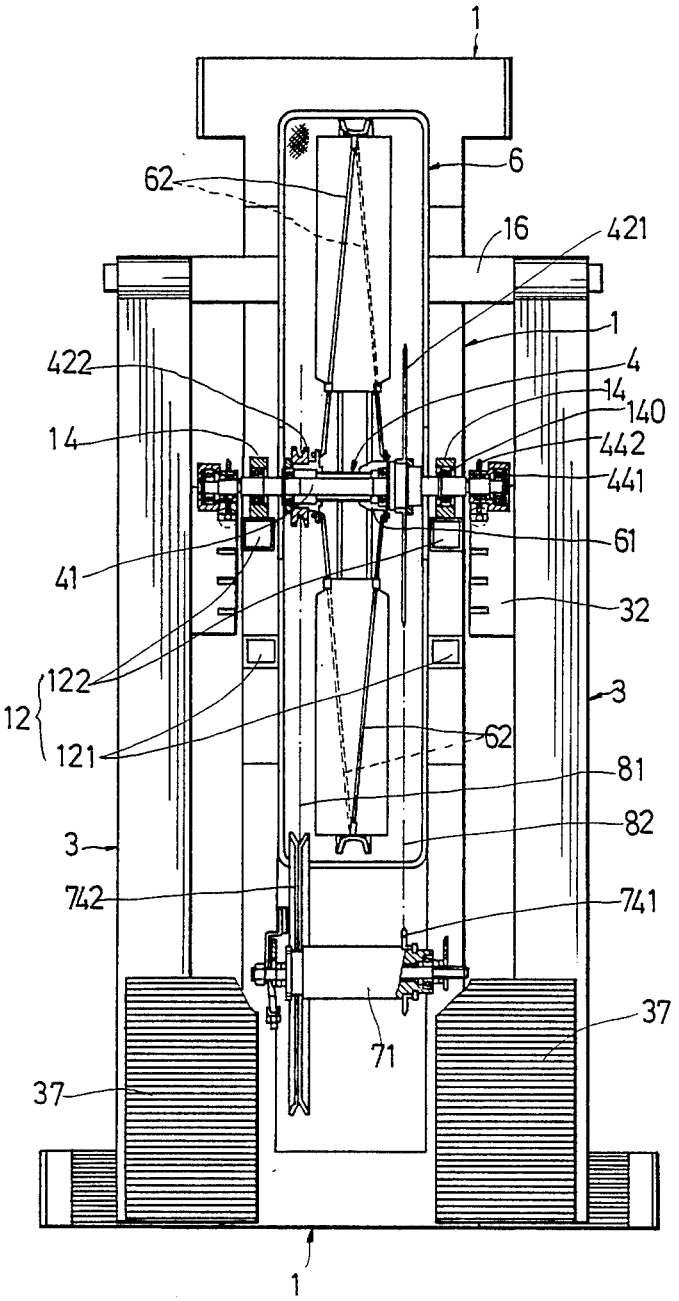
FIG. 3 is a schematic top view showing the climber of this invention.
Figure 4:
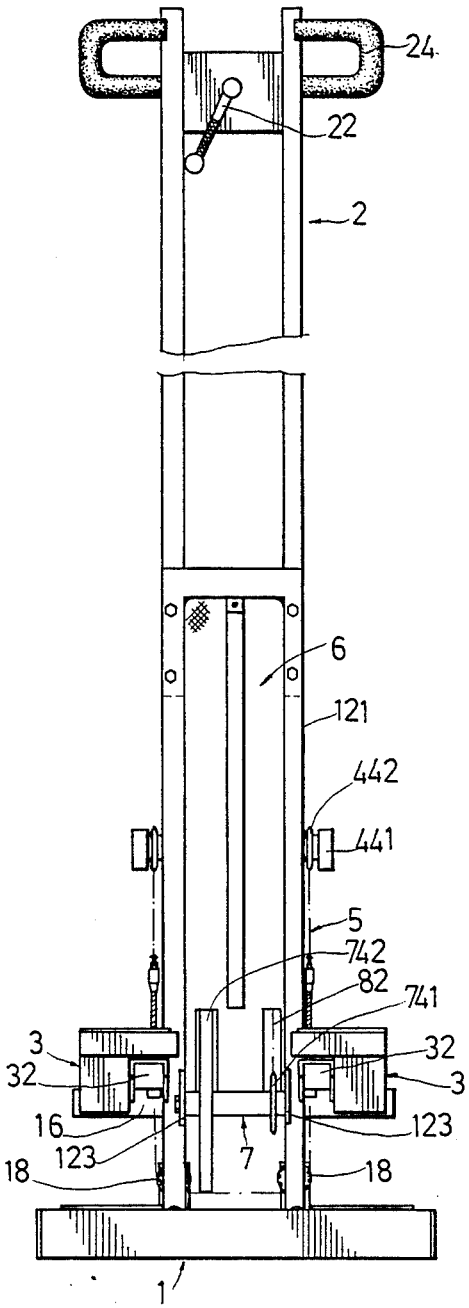
FIG. 4 is a schematic front view showing the climber of this invention.

Referring to FIGS. 2–4, a climber of this invention includes a base frame 1, a handlebar assembly 2, two parallel swing arms 3, a drive assembly 4, a combination chain/cable drawing member 5, a wheel assembly 6, and a driven shaft assembly 7.

The base frame 1 includes a main frame 12 which consists of two long parallel struts 121 and two short parallel struts 122. The short struts 122 are connected securely to the long struts 121 at the upper ends thereof. Two bearing blocks 14 are disposed on the upper end portions of the short struts 122 and accommodate two bearings 140 therein. A cross rod 16 is secured to the lower portions of the short struts 122. Two aligned lower sprockets 18 are mounted rotatably on the base frame 1.

The handlebar assembly 2 includes two U-shaped handlebars 24 disposed on two sides of the main frame 12. A socket wrench 22 is mounted on the main frame 12 in a known manner to enable the user to adjust the inclination degree of the handlebars 24.

Each of the swing rods 3 is connected rotatably to the cross rod 16 at one end thereof and carries a pedal 37 at the other end thereof. As more clearly shown in FIG. 8, two elongated positioning members 32 are respectively secured to the inner sides of the swing rods 3.

Figure 9:
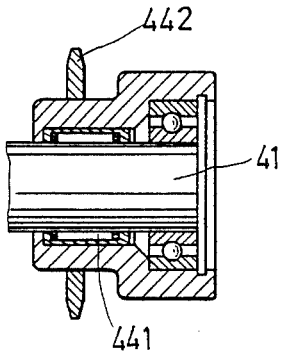
FIG. 9 is a sectional view illustrating the driving sprocket and the wheel axle of the climber according to this invention.

The drive assembly 4 includes a wheel axle 41 extending through the bearing blocks 14. Two upper sprockets 442 are sleeved rotatably on the wheel axle 41 by means of unidirectional bearings 441 (see FIGS. 3 and 9) so as to rotate the wheel axle 41 only when the upper sprockets 442 rotate in a predetermined direction.

Figure 5:
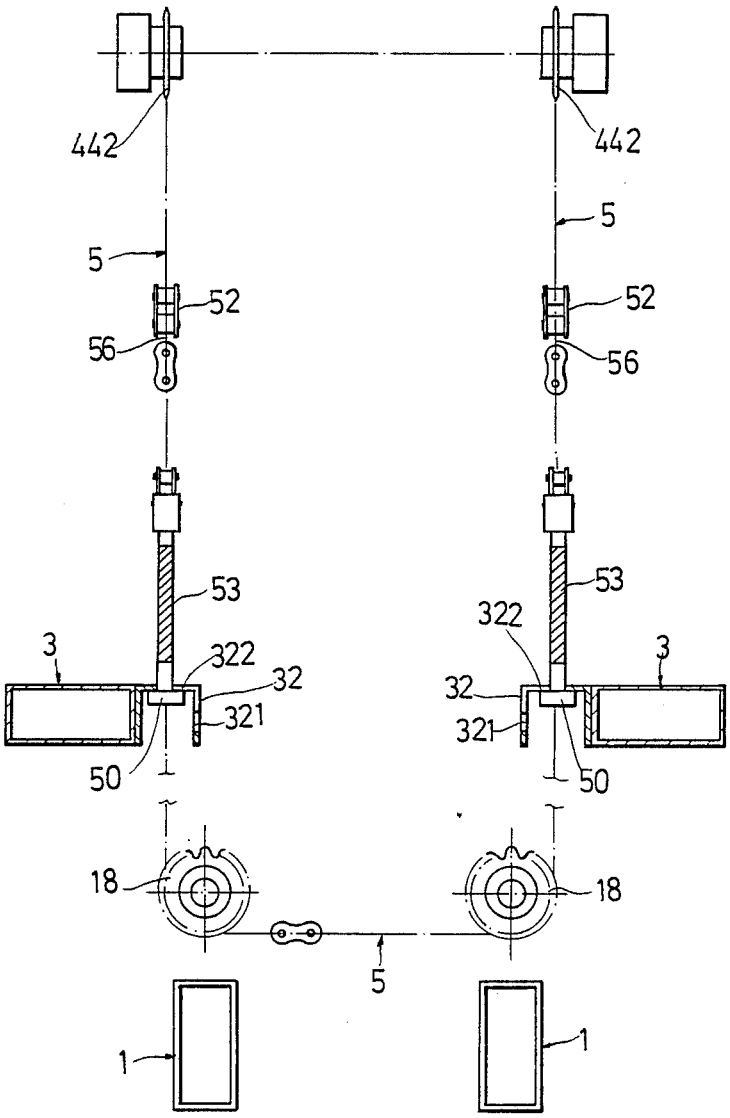
FIG. 5 is a schematic view illustrating the path of the drawing member of the climber according to this invention.

Referring to FIG. 5, the drawing member 5 has a chain-like intermediate section 52 and two cable-like end sections 53. The chain-like section 52 is in turn engaged with one of the upper sprockets 442, the lower sprockets 18 and the other one of the upper sprockets 442. Because the upper sprockets 442 are perpendicular to the lower sprockets 18, the metal links of the chain-like section 52 are rotated 90 degrees at two locations 56.

Figure 7:
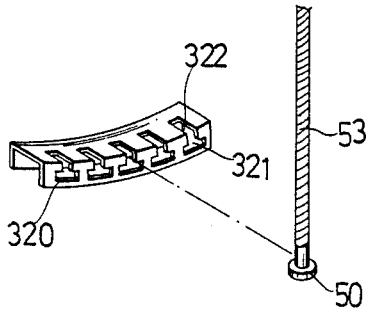
FIG. 7 is an exploded view showing the positioning device of the climber according to this invention.
Figure 8:
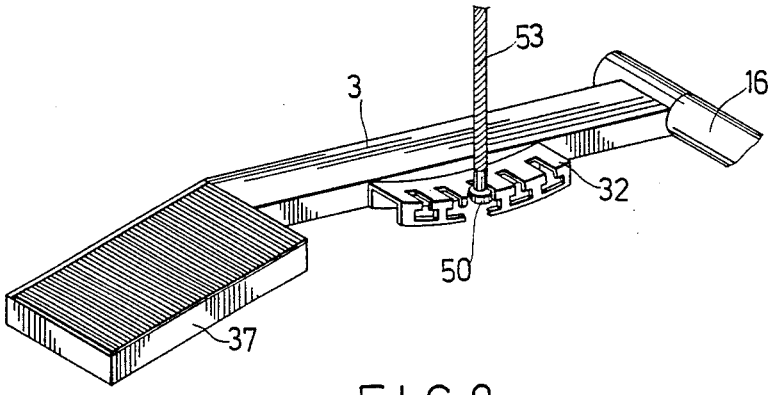
FIG. 8 is a perspective view illustrating how to couple the positioning device with the base frame of the climber in accordance with this invention.

As shown in FIGS. 7 and 8, the positioning member 32 has an inverted U-shaped cross-section and has a top wall, two side walls, and several positioning grooves 320 generally arranged along the length of the swing rod 3. Each of the positioning grooves 320 has an inverted T-shaped portion 321 formed in the upper end of one of the side walls, and an extension 322 extending from the upper end of the inverted T-shaped portion to the intermediate portion of the top wall. The cable-like section 53 of the drawing member 5 extends through the extension 322 of a selected one of the positioning grooves 320. A cylindrical blocking element 50 is secured to the lower end of the drawing member 5 in the positioning member 32 so as to prevent the lower end of the drawing member 5 from moving upward, out of the positioning member 32. The positioning member 32 is arcuated, spacing the positioning grooves 320 apart from the upper sprocket 442 at the same distance. Accordingly, the blocking element 50 can be inserted fully into the positioning member 32 through the inverted T-shaped portion 321 of any of the positioning grooves 320, so that the displacement of the pedals 37 can be adjusted.

When the user steps on and moves one of the pedals 37 downward, the drawing member 5 pulls the other of the pedals 37 upward. At the same time, the chain-like section 52 of the drawing member 5 rotates the upper sprockets 442. In use, the user alternately pumps the pedals 37 with his/her feet so as to rotate the upper sprockets 442 in alternate clockwise and counterclockwise directions, thereby rotating the wheel axle 41 in the predetermined direction.

Figure 6:
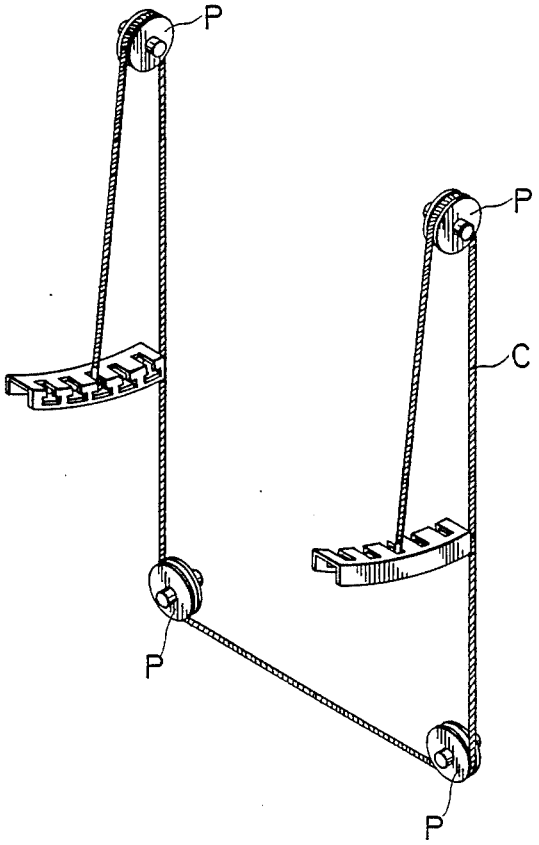
FIG. 6 is a schematic view illustrating another embodiment of the assembly shown in FIG. 5.

Alternatively, referring to FIG. 6, the engagement between the sprockets 442, 18 and the chain-like section 52 of the drawing member 5 may be changed into a combination of a cable-like section (C) and four pulleys (P), which can also achieve the rotation of the wheel axle 41.

Figure 10:
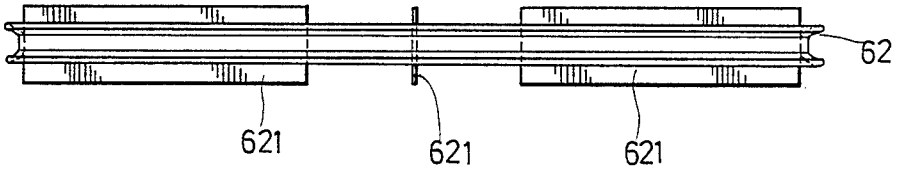
FIG. 10 is a schematic view illustrating the wheel body of the climber according to this invention.

The wheel assembly 6 includes a hub 61 sleeved rotatably on the wheel axle 41, and a wheel body 62 sleeved rigidly on the hub 61. As shown in FIG. 10, the wheel body 62 has a plurality of generally radially extending wheel blades 621 which create an air impedance to the rotation of the wheel body 62. The higher the rotational speed of the wheel body 62, the greater air impedance to the rotation of the wheel body 62.

A speed-increasing mechanism interconnects the hub 61 and the wheel axle 41, and includes a driving sprocket 421 sleeved rigidly on the wheel axle 41, a driven shaft 71 journalled on the brackets 123 of the base frame 1, a driven sprocket 741 sleeved rigidly on the driven shaft 71 and having a diameter less than that of the driving sprocket 421, an endless chain 82 trained on the driving sprocket 421 and the driven sprocket 741, a driving pulley 742 sleeved rigidly on the driven shaft 71, a driven pulley 422 sleeved rigidly on the hub 61 and having a diameter less than that of the driving pulley 742, and a V-belt 81 trained on the driving pulley 742 and the driven pulley 422. As a result, the movement of the pedals 37 is converted into the unidirectional rotation of the wheel axle 41 which is transferred to the hub 61 and the wheel body 62 via the transmission line of the driving sprocket 421, the chain 82, the driven sprocket 741, the driven shaft 71, the driving pulley 742, the V-belt 81 and the driven pulley 422. With the speed-increasing mechanism provided between the wheel axle 41 and the hub 61, the wheel body 62 can rotate at a high speed so as to give a significant air impedance to the rotation of the wheel body 62, thereby offering an intense amount of exercise to the user.

With this invention thus explained, it is apparent that numerous modifications and variations can be made without departing from the scope and spirit of this invention. It is therefore intended that this invention be limited only as indicated in the appended claims.

I claim:

1. A climber comprising:

a base frame;

a handlebar assembly fixed on said base frame so that a user can grip thereon;

two swing arms each mounted pivotally on said base frame at an end thereof;

two pedals respectively carried on the other ends of the swing arms;

a wheel axle journalled on said base frame;

two first annular members sleeved rotatably on two end portions of said wheel axle;

two unidirectional bearings each interposed between said wheel axle and one of said first annular members so as to lock said first annular members on said wheel axle when said first annular members rotate in a predetermined direction;

two second annular members mounted rotatably on said base frame;

a drawing member extending around one of said first annular members, said second annular members and the other one of said first annular members;

two positioning devices each fastening an end of said drawing member to a selected one of several positions along length of one of said swing rods so that, when a user steps on and moves one of said pedals downward, the other of said pedals is moved upward, reciprocal movement of said drawing member alternately rotating said first annular members in clockwise and counterclockwise directions, thereby rotating said wheel axle in said predetermined direction;

a hub sleeved rotatably on said wheel axle;

a wheel body sleeved rigidly on said hub and having a plurality of generally radially extending wheel blades which create air impedance to rotation of said wheel body; and a speed-increasing mechanism interconnecting said wheel axle and said hub so as to rotate said hub at a speed which is greater than that of said wheel axle.

2. A climber as claimed in claim 1, wherein said first and second annular members are sprockets, and said drawing member has a chain-like section engaged with said first and second annular members.

3. A climber as claimed in claim 1, wherein said first and second annular members are pulleys, and said drawing member has a cable-like section engaged with said first and second annular members.

4. A climber as claimed in claim 1, wherein each of said positioning devices includes:

an arcuated and elongated positioning member with an inverted U-shaped cross-section secured to said swing rod, said positioning member having a top wall, two side walls, and several positioning grooves generally arranged along length of said swing rod, each of said positioning grooves having an inverted T-shaped portion formed in an upper end of one of said side walls, and an extension extending from an upper end of said inverted T-shaped portion to an intermediate portion of said top wall, said drawing member extending through said extension of a selected one of said positioning grooves;

an blocking element secured to a lower end of said drawing member within said positioning member and shaped so as to prevent said lower end of said drawing member from moving upward out of said positioning member; and said positioning grooves being designed so as to enable both said lower end of said drawing member and said blocking member to pass through said inverted T-shaped portion of any of said positioning grooves;

whereby, said lower end of said drawing member can be retained selectively within one of said positioning grooves.

5. A climber as claimed in claim 1, wherein said speed-increasing mechanism includes:

a driving sprocket sleeved rigidly on said wheel axle;

a driven shaft journalled on said base frame;

a driven sprocket sleeved rigidly on said driven shaft and having a diameter which is smaller than that of said driving sprocket;

an endless chain trained on said driving sprocket and said driven sprocket;

a driving pulley sleeved rigidly on said driven shaft;

a driven pulley sleeved rigidly on said hub and having a diameter less than that of said driving pulley; and a V-belt trained on said driving pulley and said driven pulley.

* * * * *